United States Patent [19]

Beer

[11] 4,089,080

[45] May 16, 1978

[54] MACHINE FOR TREATING HOLLOW BOWL-SHAPED OBJECTS

[76] Inventor: Rio Beer, Unterdorfstr. 5, Niederwil, Switzerland, CH-5524

[21] Appl. No.: 774,410

[22] Filed: Mar. 4, 1977

[30] Foreign Application Priority Data

Mar. 24, 1976 Switzerland ..... 3695/76

[51] Int. Cl.[2] ..... A47L 15/38

[52] U.S. Cl. ..... 15/56; 134/104

[58] Field of Search ..... 15/56–58, 15/65, 66, 70–73, 75, 76, 101; 134/8, 22 R, 104, 143, 200

[56] References Cited

U.S. PATENT DOCUMENTS

| | | | |
|---|---|---|---|
| 1,228,851 | 6/1917 | Valerius | 15/71 |
| 2,239,047 | 4/1941 | Mathiessen | 15/56 X |
| 3,044,092 | 7/1962 | Fox et al. | 15/75 |

*Primary Examiner*—Edward L. Roberts
*Attorney, Agent, or Firm*—Peter K. Kontler

[57] ABSTRACT

A machine for washing kettles or similar hollow bowl-shaped objects has a housing with an inclined front wall having an opening and a recess surrounding the opening at the outer side of the housing. The opening can be closed by a cover which is pivoted to the housing and has a circumferentially complete marginal portion engaging the wall in the recess around the opening when the cover is moved to closed position. The housing contains rotary brushes which treat the internal and external surfaces of a properly inserted object, and such treatment takes place in the presence of a liquid which is admitted into the housing by one or more pipes whereby some liquid leaks through the opening along the marginal portion of the cover and accumulates in the recess. The wall has a port which returns collected liquid into the housing. A trough is mounted below the recess at the outer side of the wall to intercept liquid which overflows from or bypasses the recess. The housing further contains a double-acting cylinder and piston unit whose piston rod is reciprocable in parallelism with the axes of the brushes and serves to expel a treated object through the opening when the cover is moved to open position.

13 Claims, 3 Drawing Figures

MACHINE FOR TREATING HOLLOW BOWL-SHAPED OBJECTS

BACKGROUND OF THE INVENTION

The present invention relates to machines for treating hollow bowl-shaped objects, especially for washing and/or otherwise cleaning kettles, buckets, pails or analogous containers. More particularly, the invention relates to improvements in machines of the type wherein objects to be treated are introduced into the chamber of a housing and are treated by one or more rotating or otherwise moving implements (particularly brushes), normally in the presence of water or another liquid medium.

Swiss Pat. No. 541,365 discloses a machine for washing bowl-shaped objects wherein the housing contains a rotary cylindrical brush having a free end which is adjacent an opening serving for introduction of objects into and for removal of treated objects from the housing. A drawback of the patented machine is that the objects must be inserted and removed by hand. This is a tiresome procedure which takes up much time, especially if the objects are relatively heavy and bulky. The removal of treated objects is particularly cumbersome, especially if a treated object must be lifted and simultaneously removed from the housing by way of a relatively small opening.

Another drawback of presently known machines is that the cover or door which seals the opening during treatment (and/or the wall which is formed with such opening) must be provided with complex and costly elastic seals to prevent the escape of liquid which is admitted into the housing during treatment of objects by means of one or more brushes or analogous implements. The liquid often contains detergents or other chemicals which attack the material of the seals so that the seals must be inspected, repaired or replaced at frequent intervals. This, too, reduces the output of such machines and contributes to the maintenance cost.

OBJECTS AND SUMMARY OF THE INVENTION

An object of the invention is to provide a machine for treatment of hollow bowl-shaped objects with novel and improved means for facilitating the movement of objects with respect to the housing wherein the treatment of objects takes place, especially for facilitating or effecting removal of treated objects from the housing.

Another object of the invention is to provide the machine with novel and improved means for expelling treated objects from the chamber in which the objects are washed or otherwise treated by one or more implements, normally in the presence of a liquid medium.

A further object of the invention is to provide the machine with simple, inexpensive and long-lasting means for collecting liquid which leaks from the housing during treatment of objects therein.

An additional object of the invention is to provide a novel and improved housing for a machine of the above outlined character.

An ancillary object of the invention is to provide a machine wherein the liquid which happens to leak from the housing during treatment of objects can be reused.

Still another object of the invention is to provide the machine with novel and improved means for intercepting escaping liquid even if the liquid escapes at a relatively high rate due to the absence of elastic seals and like sensitive parts which are likely to be attacked by chemicals in the liquid and/or by heat if the treatment involves contacting the objects with a heated liquid medium.

One feature of the invention resides in the provision of a machine for treating hollow bowl-shaped objects, particularly for washing kettles or the like. The machine comprises a housing which defines a chamber and has an opening for introduction of objects into and removal of treated objects from the chamber, at least one rotary brush or other suitable driven treating implement which is mounted in the housing and serves to treat a properly inserted object in the chamber, and means for removing treated objects from the chamber by way of the opening. The removing means includes an ejector (e.g., the piston rod of a double-acting cylinder and piston unit) which is movable between a retracted position in which the ejector is remote from the opening and permits insertion of an object into the chamber and into the range of the treating implement or implements, and an extended position nearer to the opening. While moving from the retracted position, the ejector expels a treated object from the chamber by way of the opening, or at least causes the treated object to assume a position in which it can be readily grasped by hand or by automatic transporting means. It is preferred to mount the ejector for reciprocatory movement in parallelism with the axis of a rotary brush or an analogous rotary treating implement in the chamber. The ejector may be provided with follower means which tracks an elongated rail or another suitable guide during movement of the ejector between extended and retracted positions.

Another feature of the invention resides in the provision of a housing whose opening is formed in a recessed portion of an inclined front wall. The housing further comprises a door or cover which is pivotable or otherwise movable to and from an operative (closed) position in which a circumferentially complete marginal portion of the cover engages the outer side of the recessed portion around the opening. Any liquid which leaks from the housing between the marginal portion of the cover and the recessed portion of the front wall is collected by the recessed portion and is returned into the chamber of the housing or into a tank whence the liquid is pumped back into the housing. If desired or necessary, the housing may be provided with one or more additional collecting means located at the outer side of the front wall below the recessed portion to intercept liquid that bypasses or overflows from the recessed portion. The just described mode of collecting liquid which leaks from the housing renders it possible to prevent contamination of the surrounding area without necessarily resorting to elastic seals or other sensitive sealing means, either on the cover or on the inclined wall of the housing.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
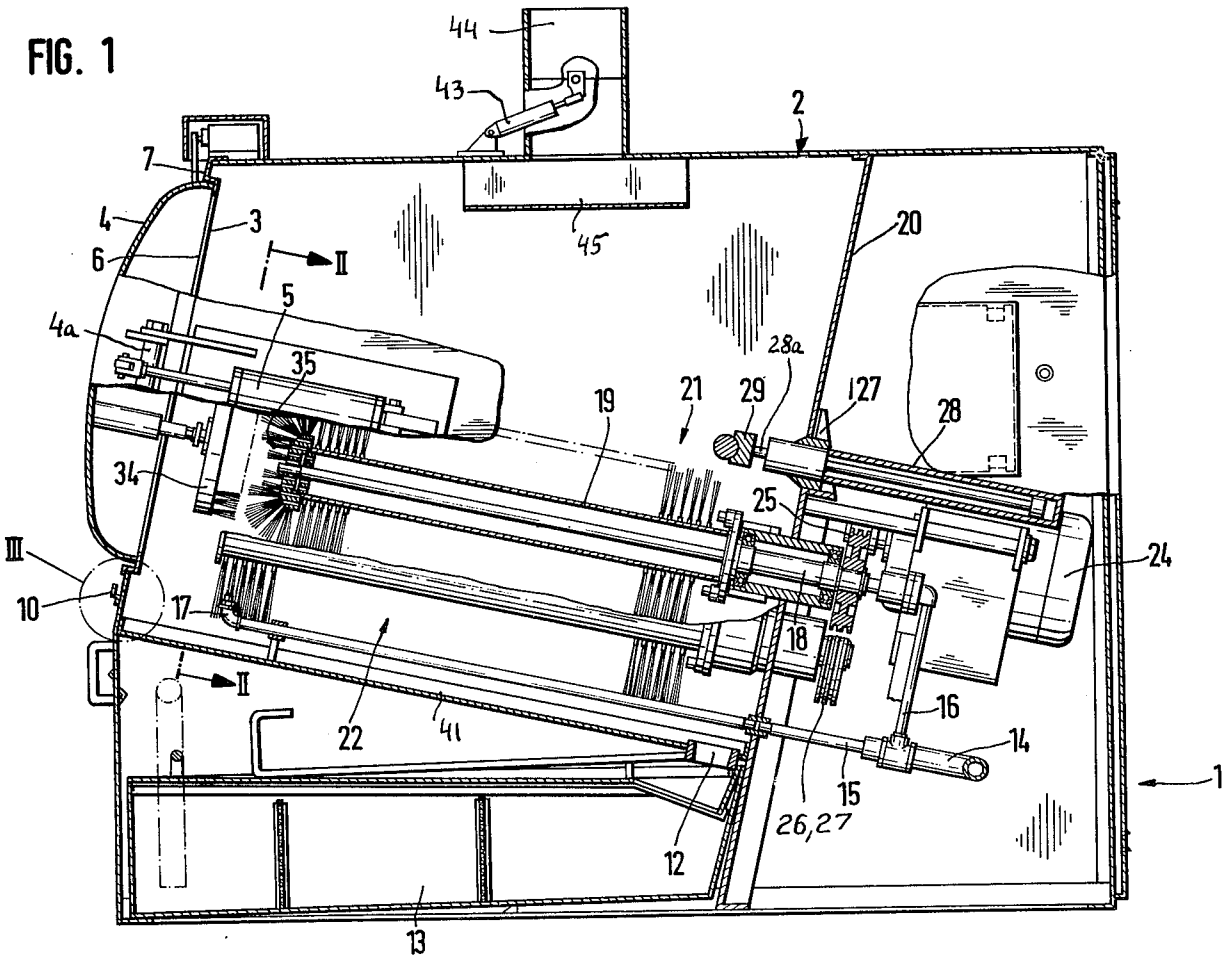
FIG. 1 is a schematic partly elevational and partly longitudinal vertical sectional view of a machine which embodies the invention.
Figure 2:
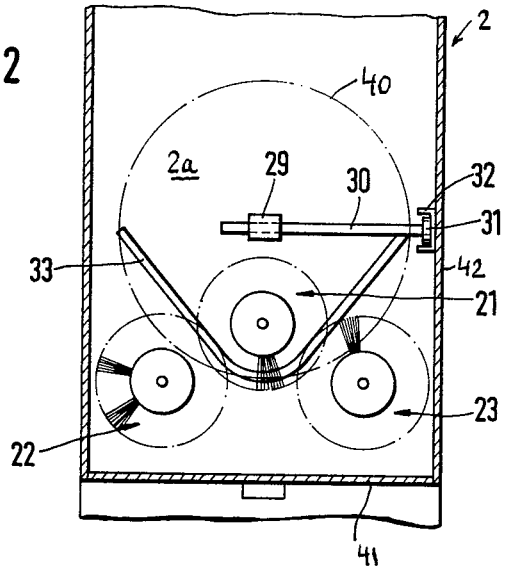
FIG. 2 is a sectional view as seen in the direction of arrows from the line II—II of FIG. 1.
Figure 3:
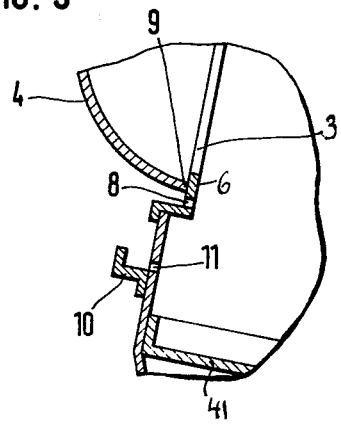
FIG. 3 is an enlarged view of a detail within the phantom line circle III shown in FIG. 1.

Referring first to FIG. 1, the machine comprises a frame 1 which supports a housing 2 having an inclined front wall 7 including a recessed annular portion 6 (FIG. 3) which is formed with a circular opening 3 for admission of hollow bowl-shaped objects 40 (one indicated in FIG. 2 by a phantom-line circle) and for evacuation or removal of treated objects. A round cover or door 4 is pivotably secured to the wall 7 by a hange 4*a* and is movable between an open position (not shown) and a closed or operative position (shown in FIGS. 1 and 2) in which its circumferentially complete marginal portion or rib 9 (FIG. 3) engages or is immediately adjacent the outer side of the recessed portion 6 of the front wall 7 whereby the marginal portion 9 surrounds the opening 3. The means for moving the cover 4 between open and closed positions comprises a motor 5 here shown as a double-acting pneumatic or hydraulic cylinder and piston unit whose piston rod is secured to the outer side of the housing 2 or to the frame 1 and whose piston rod is articulately coupled to the cover 4.

The lower zone of the recessed portion 6 of the preferably flat front wall 7 constitutes a means for collecting or intercepting liquid which leaks from the chamber 2*a* of the housing 2 while an object 40 in the chamber 2*a* is treated by several rotary treating implements here shown as brushes 21, 22, 23 and 34. The inner side of the cover 4 is concave and the brush 34 is rotatably or fixedly mounted at such inner side of the cover 4 to extend into the chamber 2*a* and to treat the outer side of the bottom wall of a properly inserted object 40 when the cover is held in the closed position of FIG. 1 or 2. The liquid which accumulates in the lower zone of the recessed portion 6 can return into the chamber 2*a* by way of a bore or port 8 (see FIG. 3) which is provided in the recessed portion below the opening 3. Any liquid which bypasses or overflows from the recessed portion 6 flows along the outer side of the inclined front wall 7 and is intercepted by a second collecting device here shown as a trough 10 consisting mainly of Z-shaped metallic stock and welded or otherwise sealingly secured to the outer side of the wall 7 below the recessed portion 6. The wall 7 has a second port 11 which allows liquid to flow from the deepmost portion of the trough 10 back into the chamber 2*a*.

The brush 34 at the inner side of the cover 4 may but need not be driven; it normally suffices to rotatably mount the brush 34 on the cover 4 because (if desired or necessary) the brush will rotate automatically in response to rotation of the object 40 when the machine is in use.

The inclined bottom wall 41 of the housing 2 has an outlet opening 12 which discharges accumulated liquid into a tank 13 in the lower portion of the frame 1. The latter stores a supply of washing liquid (e.g., hot or cold water which contains one or more detergents or other chemicals serving to promote the cleaning action of the brushes 21–23 and 34). A pump (not shown) is provided to draw liquid from the tank 13 and to admit a stream of liquid into a pipe 14 having two branches 15 and 16. The branch 15 extends through the rear wall 20 of the housing 2 and toward the opening 3. Its free end carries a nozzle 17 which sprays liquid against the outer side of an object 40 in the chamber 2*a* at a level below and slightly inwardly of the brush 34 on the cover 4. The branch 16 admits pressurized liquid into a hollow shaft 18 which is journalled in the rear wall 20 of the housing 2 and drives the hollow cylindrical core 19 of the brush 21. The axial passage of the shaft 18 discharges liquid against the innermost portion of the internal surface of an object 40 in the chamber 2*a*. The outlet of the shaft 18 can admit liquid into a nozzle 35 which sprays the liquid not only against the innermost portion but also against the remaining portion of the internal surface of an object 40 in the housing 2. The shafts of the brushes 22 and 23 are also journalled in the rear wall 20 of the housing and these brushes are installed in such a way that their bristles engage and treat the external surface of a properly inserted object 40 in contrast to the bristles of the brush 21 which treats the major portion of the internal surface of the object. When an object is properly inserted into the chamber 2*a* (by way of the opening 3), a portion thereof extends between the bristles of the brush 21 on the one hand and the bristles of the brushes 22, 23 on the other hand (see FIG. 2). The deformed bristles thereby maintain the object 40 in requisite position. The bristles of the brush 34 engage the outer side of the bottom wall of such object as soon s the cover 4 is moved to the closed position. The brushes 22, 23 flank the brush 21 and their axes are parallel to and located at a level below the axis of the shaft 18.

The means for rotating the brushes 21–23 comprises an electric motor 24 or another suitable prime mover which is mounted in the frame 1 or at the outer side of the rear wall 20 of the housing 2 and transmits torque to the shafts of the brushes 21–23 by way of pulleys 25–27 and an endless V-belt (not shown). If desired, the pulleys can be replaced with sprocket wheels if the endless flexible element is a chain, or the means for transmitting torque from the output shaft of the motor 24 to the brushes 21–23 may comprise one or more gear trains.

When the brushes 21–23 rotate, they cause the body 40 to rotate about its own axis so that the bristles of the brush 21 clean the internal surface, the bristles of the brushes 22–23 clean the major part of the external surface and the bristles of the brush 34 clean the outer side of the bottom wall of the rotating body.

The means for removing treated objects 40 from the chamber 2*a* comprises a pneumatically or hydraulically operated motor 28 here shown as a double-acting cylinder and piston unit whose cylinder is mounted in the rear wall 20 of the housing 2, as at 127, and whose piston rod 28*a* constitutes an ejector. The front end portion of the piston rod 28*a* carries a socket 29 for a laterally extending arm 30 (see FIG. 2) forming part of a follower which further includes a roller 31 installed at the free end of the arm 30 and extending into a track defined by an elongated guide rail 32 secured to the inner side of a side wall 42 of the housing 2. The guide rail 32 insures that the piston rod 28*a* is reciprocable in parallelism with the axes of the brushes 21–23 between a retracted position (shown in FIG. 1) in which an object-engaging U-shaped yoke 33 of the piston rod 28*a* is remote from the opening 3 and does not interfere with introduction of an object 40 into the chamber 2a, and an extended position in which the yoke 33 is close to the opening 3. During movement from the retracted to the extended position, the yoke 33 of the piston rod 28a causes a treated object 40 to leave the chamber 2a by way of the opening 3 (it being assumed that the cover 4 is then held in the open position). The yoke 33 is secured to the arm 30 close to the rail 32 and its free end is located at the other side of the brush 21; this yoke can engage the open end of a treated object at two, three or more points. The length of stroke of the piston rod 28a from retracted to extended position is sufficient to insure that the object 40 is fully expelled or that the object assumes a position in or very close to the opening 3 so that it can be readily grasped by hand or by automatic transporting means, not shown. The rail 32 not only insures that the piston rod 28a moves in parallelism with the shaft 18 but further serves to prevent rotation of the piston rod about its own axis. The yoke 33 is preferably located in a plane which is normal to the axis of the piston rod 28a. It will be noted that the yoke extends between the brush 21 on the one hand and the brushes 22, 23 on the other hand.

The motors 5 and 28 are preferably operated by a gaseous fluid medium and the machine preferably comprises a common source of compressed gas for both motors. The arrangement is preferably such that the connection from the source of compressed gas to the motor 28 comprises a flow restrictor which delays the actuation of piston rod 28a in a direction to expel a treated object 40 so that the motor 5 opens the cover 4 before the yoke 33 reaches and begins to displace the object in a direction toward and into the opening 3.

The operation is as follows:

The cover 4 is assumed to be held in the open position. An attendant introduces an object into the chamber 2a by way of the opening 3 so that the annular portion of the object penetrates between the bristles of the brush 21 on the one hand and the bristles of the brushes 22, 23 on the other hand. The piston rod 28a is held in the retracted position of FIG. 1 so that its yoke 33 does not interfere with introduction of the object 40 into the housing 2. The motor 5 is thereupon actuated to move the cover 4 to the closed position of FIG. 1 whereby the bristles of the brush 34 engage and (if necessary) shift the object 40 relative to the brushes 21–23. In the next step, the motor 24 is started to rotate the brushes 21–23 and to thereby cause the object 40 to rotate about its own axis. At the same time, the attendant starts the pump which conveys pressurized liquid from the tank 13 into the pipe 14 and thence into the branches 15, 16 and nozzles 17, 35. The nozzle 17 sprays liquid against the external surface and the nozzle 35 sprays liquid against the internal surface of the rotating object 40 in the chamber 2a. The liquid descends onto the bottom wall 41 of the housing 2 and escapes via outlet 12, i.e., it flows back into the tank 13.

The bristles of the brushes 21–23 and 34 spray the liquid in the interior of the housing 2 and some of the liquid is likely to reach the internal surface of the cover 4 and to flow toward the marginal portion 9. Capillary forces which develop between the marginal portion 9 and the adjacent surface of the recessed portion 6 retain a substantial quantity of liquid which tends to escape between the parts 6 and 9; at any rate, such capillary forces prevent pronounced outflow of liquid from the housing 2. Any liquid which leaks between the parts 6 and 9 flows into the lower zone of the recessed portion 6 and is returned into the chamber 2a by way of the port 8. If the port 8 is clogged or cannot permit return flow of liquid into the chamber 2a at the rate at which liquid leaks into the recessed portion 6, the liquid overflows into the collecting trough 10 and is returned into the chamber 2a by way of the port 11. If desired, the outer side of the inclined front wall 7 can support more than one collecting trough 10 and such plural troughs are preferably mounted at different levels so that liquid which overflows from the trough 10 of FIG. 3 can flow into the trough therebelow.

When the cleaning operation is completed, the motor 24 is arrested together with the pump which draws liquid from the tank 13. A pneumatic motor 43 then opens a flap in a duct 44 which is located above a fan 45. The fan 45 is started and remains in operation for a certain interval of time to evacuate vapors from the chamber 2a. When the fan 45 is arrested, the motor 5 is actuated to open the cover 4 and the motor 28 is actuated with a certain delay to move the yoke 33 toward the opening 3 and to thus expel the treated object 40 from the chamber 2a. As mentioned above, the motors 5 and 28 can receive pressurized fluid simultaneously; however, the movement of piston rod 28a toward the opening 3 is delayed due to the provision of the aforementioned flow restrictor in the connection between the source of pressurized fluid and the corresponding chamber of the cylinder of the motor 28. It is possible to start the cover 4 and the piston rod 28a simultaneously but to move the piston rod at a relatively low speed so that the cover 4 is open before the bottom wall of the treated object 40 enters the opening 3.

In the next step, the system of valves between the source of pressurized fluid and the motor 28 admits pressurized fluid into the other chamber of the cylinder of the motor 28 to return the piston rod 28a to the retracted position shown in FIG. 1. The first mentioned chamber of the cylinder in the motor 28 is then connected with the atmosphere. The operator can introduce the next object which is inserted between the brushes 21 and 22–23 before the cover 4 is returned to the closed position.

An important advantage of the improved machine is that the removal of treated objects is effected automatically or that such removal is simplified because the yoke 33 can move a treated object to a position in which the object is more readily accessible than in the fully inserted position.

Another advantage of the improved machine is that the wall 7 and/or the cover 4 need not be equipped with complex and sensitive sealing means because, even if some liquid is allowed to escape between the parts 6 and 9, such liquid is intercepted and returned into the chamber 2a or directly into the tank 13 for recirculation through the machine.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A machine for treating hollow bowl-shaped objects, particularly for washing kettles or the like, comprising a housing defining a chamber and having an opening for introduction of objects into and removal of treated objects from said chamber; at least one driven treating implement mounted in said housing and arranged to treat an object in said chamber; and means for removing treated objects from said chamber, including an ejector movable between a retracted position in which said ejector is remote from said opening and permits insertion of an object into said chamber and into the range of said implement, and an extended position nearer to said opening whereby the ejector expels a treated object during movement from said retracted to said extended position thereof, and means for moving said ejector between said positions.

2. A machine as defined in claim 1, wherein said implement is rotatable about a predetermined axis and has a free end adjacent said opening, said ejector being reciprocable between said positions along a path which is substantially parallel to said axis.

3. A machine as defined in claim 2, wherein said removing means is a fluid-operated motor having a reciprocable piston rod which constitutes said ejector.

4. A machine as defined in claim 2, further comprising guide means provided in said chamber, said ejector having follower means tracking said guide means.

5. A machine as defined in claim 4, wherein said guide means comprises an elongated rail mounted in said housing and said follower means comprises an arm extending laterally from said ejector and having roller means engaging said rail.

6. A machine as defined in claim 2, wherein said ejector comprises an object-engaging yoke located in a plane which is substantially normal to said axis.

7. A machine for treating hollow bowl-shaped objects, particularly for washing kettles or the like, comprising a housing defining a chamber and including an inclined wall having an opening for introduction of objects into and removal of treated objects from said chamber, said housing further having a cover movable to and from an operative position in which said cover cioses said opening; at least one treating implement installed in said housing and operable to treat an object in said chamber; and means for admitting a liquid into said chamber whereby some liquid tends to leak from said housing by way of said opening, said wall having means for collecting the liquid which leaves said chamber by way of said opening.

8. A machine as defined in claim 7, wherein said cover has a circumferentially complete marginal portion which engages said wall and surrounds said opening in the operative position of said cover.

9. A machine as defined in claim 8, wherein said wall has a recessed portion and said opening is provided in said recessed portion, said collecting means forming part of said recessed portion.

10. A machine as defined in claim 9, further comprising second collecting means provided on said wall below said recessed portion to intercept liquid which bypasses or overflows from said recessed portion.

11. A machine as defined in claim 7, wherein said collecting means comprises several liquid intercepting devices provided on said wall below said opening and disposed at different levels.

12. A machine as defined in claim 7, further comprising means for returning liquid from said collecting means into said chamber.

13. A machine as defined in claim 7, wherein said implement is a rotary brush.

* * * * *